US007229370B1

(12) United States Patent
Vacek et al.

(10) Patent No.: US 7,229,370 B1
(45) Date of Patent: Jun. 12, 2007

(54) FILAMENT WOUND BAT AND WINDING AND MOLDING METHOD THEREFORE

(75) Inventors: Matthew Vacek, Brownsville, MN (US); Richard George, Holmen, WI (US)

(73) Assignee: Rawlings Sporting Goods Company, Inc., St. Louis, MO (US)

( * ) Notice: Subject to any disclaimer, the term of this patent is extended or adjusted under 35 U.S.C. 154(b) by 6 days.

(21) Appl. No.: 11/073,366

(22) Filed: Mar. 4, 2005

Related U.S. Application Data

(63) Continuation-in-part of application No. 10/438,196, filed on May 14, 2003, which is a continuation-in-part of application No. 09/883,790, filed on Jun. 18, 2001.

(60) Provisional application No. 60/263,020, filed on Jan. 19, 2001.

(51) Int. Cl.
*A63B 59/06* (2006.01)

(52) U.S. Cl. ..... 473/567

(58) Field of Classification Search ..... 473/564–567, 473/457, 519, 520
See application file for complete search history.

(56) References Cited

U.S. PATENT DOCUMENTS

| | | | | |
|---|---|---|---|---|
| 3,861,682 | A | 1/1975 | Fujii | |
| 3,963,239 | A | 6/1976 | Fujii | |
| 4,025,377 | A | 5/1977 | Tanikawa | |
| 4,347,280 | A | 8/1982 | Lau | |
| 4,505,479 | A | 3/1985 | Souders | |
| 4,644,630 | A | 2/1987 | Blum | |
| 4,660,832 | A | 4/1987 | Shomo | |
| 4,848,745 | A * | 7/1989 | Bohannan et al. | 473/119 |
| 5,114,144 | A | 5/1992 | Baum | |
| 5,415,398 | A | 5/1995 | Eggiman | |
| 5,496,027 | A | 3/1996 | Christian et al. | |
| 5,651,740 | A | 7/1997 | Munoz | |

(Continued)

FOREIGN PATENT DOCUMENTS

| | | |
|---|---|---|
| FR | 2462266 | 2/1981 |

(Continued)

OTHER PUBLICATIONS

Publication 03433481, Mar. 1969.

(Continued)

*Primary Examiner*—Mark S. Graham
(74) *Attorney, Agent, or Firm*—Waddey & Patterson, P.C.; Phillip E. Walker; Edward D. Lanquist, Jr.

(57) ABSTRACT

A method and apparatus for manufacturing a bat having an exterior and a hollow interior. The method consists of successive steps of placing a first layer of filament onto a rotating mandrel while simultaneously applying resin to the first layer; winding additional layers of filament around the first layer without resin; and vacuum transfer molding additional resin onto the filament layers so that the additional resin impregnates these layers. The apparatus consists of a mandrel; a mandrel holder allowing rotation of the mandrel; a resin applicator adjacent the mandrel of the same length as the mandrel; a filament winder for winding filament onto the mandrel; and a vacuum transfer molding apparatus. A bat made by this method is also disclosed. The present invention also relates to a resin bath to apply resin to a line of filament.

6 Claims, 6 Drawing Sheets

U.S. PATENT DOCUMENTS

| | | | | |
|---|---|---|---|---|
| 5,743,811 | A | 4/1998 | Bird | |
| 5,904,803 | A | 5/1999 | Hillerich | |
| 6,010,417 | A | 1/2000 | Young et al. | |
| 6,042,493 | A | 3/2000 | Chauvin | |
| 6,152,840 | A | 11/2000 | Baum | |
| 6,234,922 | B1 | 5/2001 | White | |
| 6,234,924 | B1 | 5/2001 | Washburn, Jr. | |
| 6,235,134 | B1 | 5/2001 | Mueller | |
| 6,238,309 | B1 | 5/2001 | Sample | |
| 6,287,221 | B1 | 9/2001 | Pino | |
| 6,322,463 | B1 | 11/2001 | Forsythe | |
| 6,352,485 | B1 | 3/2002 | Philpot | |
| 6,383,101 | B2 | 5/2002 | Eggiman | |
| 6,406,388 | B1 | 6/2002 | Monty | |
| 6,461,260 | B1 | 10/2002 | Higginbotham | |
| 6,482,114 | B1 | 11/2002 | Eggiman | |
| 6,497,631 | B1 | 12/2002 | Fritzke | |
| 6,634,969 | B2 | 10/2003 | Forsythe | |
| 6,663,517 | B2 | 12/2003 | Buiatti | |
| 2001/0012807 | A1* | 8/2001 | Eggiman et al. | 473/564 |
| 2001/0046910 | A1 | 11/2001 | Sutherland | |
| 2002/0091022 | A1 | 7/2002 | Fritzke | |
| 2002/0128095 | A1 | 9/2002 | Flood | |
| 2003/0148836 | A1 | 8/2003 | Falone | |
| 2003/0228816 | A1 | 12/2003 | Dimario | |
| 2004/0053716 | A1 | 3/2004 | Wu | |
| 2004/0176197 | A1* | 9/2004 | Sutherland | 473/564 |

FOREIGN PATENT DOCUMENTS

| | | |
|---|---|---|
| FR | 2560551 | 9/1985 |
| JP | 3247365 | 11/1991 |
| JP | 564671 | 3/1993 |
| WO | WO00/35540 | 6/2000 |
| WO | WO 2003/066174 A1 | 8/2003 |

OTHER PUBLICATIONS

Publication No. 1516807/GB-A, Great Britain, Jul. 1978.
Publication No. 1326943/GB-A, Great Britain, , Aug. 1973.
Publication No. 02011130 JP, Japan, Jan. 2002.
Publication No. 01054605 JP, Japan, Feb. 2001.
Publication No. 00312732 JP, Japan, Nov. 2000.
Publication No. 11128424 JP, Japan, May 1999.
Publication No. 08191909 JP, Japan, Jul. 1996.
Publication No. 07299171 JP, Japan, Nov. 1995.
Publication No. 2003/066174/WO-A1, Aug. 2003.
Publication No. 2000/035540/WO-A1, Jun. 2000.
Publication No. 2000/001449/WO-A1, Jan. 2000.
Publication No. 1995021001/WO-A1, Aug. 1995.
Publication No. 1993003951/WO-A1, Mar. 1993.
Publication No. 1991016953/WO-A1, Nov. 1991.

* cited by examiner

FILAMENT WOUND BAT AND WINDING AND MOLDING METHOD THEREFORE

This application is a continuation-in-part application of U.S. patent application Ser. No. 10/438,196 entitled "Composite Softball Bat" filed on May 14, 2003 which is a continuation-in-part application of U.S. patent application Ser. No. 09/883,790 entitled "Composite Softball Bat" filed on Jun. 18, 2001, which claims priority under U.S.C. 119(e) from U.S. Provisional Application Ser. No. 60/263,020 filed Jan. 19, 2001, which applications are incorporated herein by reference.

BACKGROUND OF THE INVENTION

The present invention is directed to objects, and particularly, baseball and softball bats, that have a hollow shell composed of filament-wound fiber and resin, and to a method of winding the object and of molding the object.

For many years, softball bats were made of wood. Traditional athletic bats comprised of wood are expensive and consume valuable natural resources. A disadvantage of wood bats is that they frequently break during use. A further disadvantage of wood bats is that they are exceedingly difficult to design for consistent performance, given the inconsistency of the natural material. In addition, wooden bats are made of ash or very hard pine. The sources of such woods are becomingly increasingly rare.

In the past fifteen or twenty years, softball bats made of metal were introduced. Metal bats, although more durable than wood bats, also have problems. One of the many problems associated with a metal bat is that the material is fixed and, as a result, so are the parameters of the material. Metal bats have a fixed density and a given weight. As a result, the engineering parameters that can be varied can only be varied within a limited range.

Currently, metal softball bats are more commonly used than wooden softball bats. A common structure in various non-wooden softball bats includes a hollow bat made with a handle and a hitting surface. The hitting surface includes a tubular portion and a sleeve fit inside the tubular portion. The sleeve is also made of metal. The metal bat and sleeve construction has problems. Several of the problems associated with metal softball bats having metal sleeves stem from the impact or large shock load exerted on the metal bat as a result of hitting a softball. The shock loading produces extremely large forces between the bat and the ball. The result is that the metal bat dents when the ball is hit. Some dents are small and some dents are large. Regardless of the size of the dent, energy is lost on every hit since some of the energy is used to dent the metal rather than to be transferred to the softball. The dents also result in a less durable bat. Once dented, each subsequent hit is a further cold working of the metal. In some instances, a microscopic crack can also be formed as the result of denting of the bat. The crack will get bigger and bigger until the amount of material left fails due to shock loading. Many bats fail quickly. Some bats may fail after as few as twenty-five hits.

More recently, composite bats have been introduced. Composite bats include a reinforced plastic with a metal portion. Examples of U.S. Patents disclosing such composite bats and the problems of such bats are disclosed in the prior, co-pending applications.

Prior, co-pending application Ser. No. 10/438,196 discloses and claims a hollow bat that is comprised of a plurality of composite sleeves made of fibers and resin. The bat is formed and made according to a resin transfer molding process. U.S. Pat. No. 5,811,041, herein incorporated by reference, discloses a resin transfer molding apparatus and method for vacuum transfer molding.

Earlier methods have not completely addressed the problem of producing a hollow bat. In particular, "wet winding" methods, in which the resin is applied to the filament prior to the filament being wound onto the mandrel, require some method, such as a shrink tape, to ensure that the bat is cured under pressure to the designed dimensions. Vacuum transfer mold methods do not work well with bats with thick walls, as it is difficult to fully impregnate the filament. Multiple sleeve methods take considerable time and cost to manufacture the bat.

There is a need for an improved, hollow bat made of filament wound fiber and resin. The inner layers of the bat should be filament wound to save cost and time over using a number of sleeves. The outer layers of the bat should be resin transfer molded. This will ensure thorough filament wet-out throughout the bat and thus ensure uniform properties of performance and durability.

Most composite bats are created by hand using a sock or sheet of woven composite material. While in some instances convenient, the sock or sheet can be expensive and require the manufacture to keep on hand inventory of the material.

SUMMARY OF THE INVENTION

A method and apparatus for manufacturing a bat having an exterior and a hollow interior. The method consists of successive steps of placing a first layer of filament onto a rotating mandrel while simultaneously or non simultaneously applying resin to the first layer; winding additional layers of filament around the first layer without resin; and vacuum transfer molding additional resin onto the filament layers so that the additional resin impregnates these layers. The apparatus consists of a mandrel; a mandrel holder allowing rotation of the mandrel; a resin applicator adjacent the mandrel of the same length as the mandrel; a filament winder for winding filament onto the mandrel; and a vacuum transfer molding apparatus. A bat made by this method is also disclosed.

A principle object and advantage of the present invention is that it saves manufacturing time and cost over previous methods of using a plurality of composite sleeves of fibers and resin.

Another object and advantage of the present invention is that it allows the manufacturing of thicker bats by ensuring complete impregnation of the resin in the filament.

Another object of the present invention is that the fiber angle can be changed in successive layers or in the same layer.

Another object of the present invention is to allow just in time control over fiber materials and fiber angle without relying upon a prefabricated sheet or sock.

DETAILED DESCRIPTION OF THE PREFERRED EMBODIMENT

Figure 1:
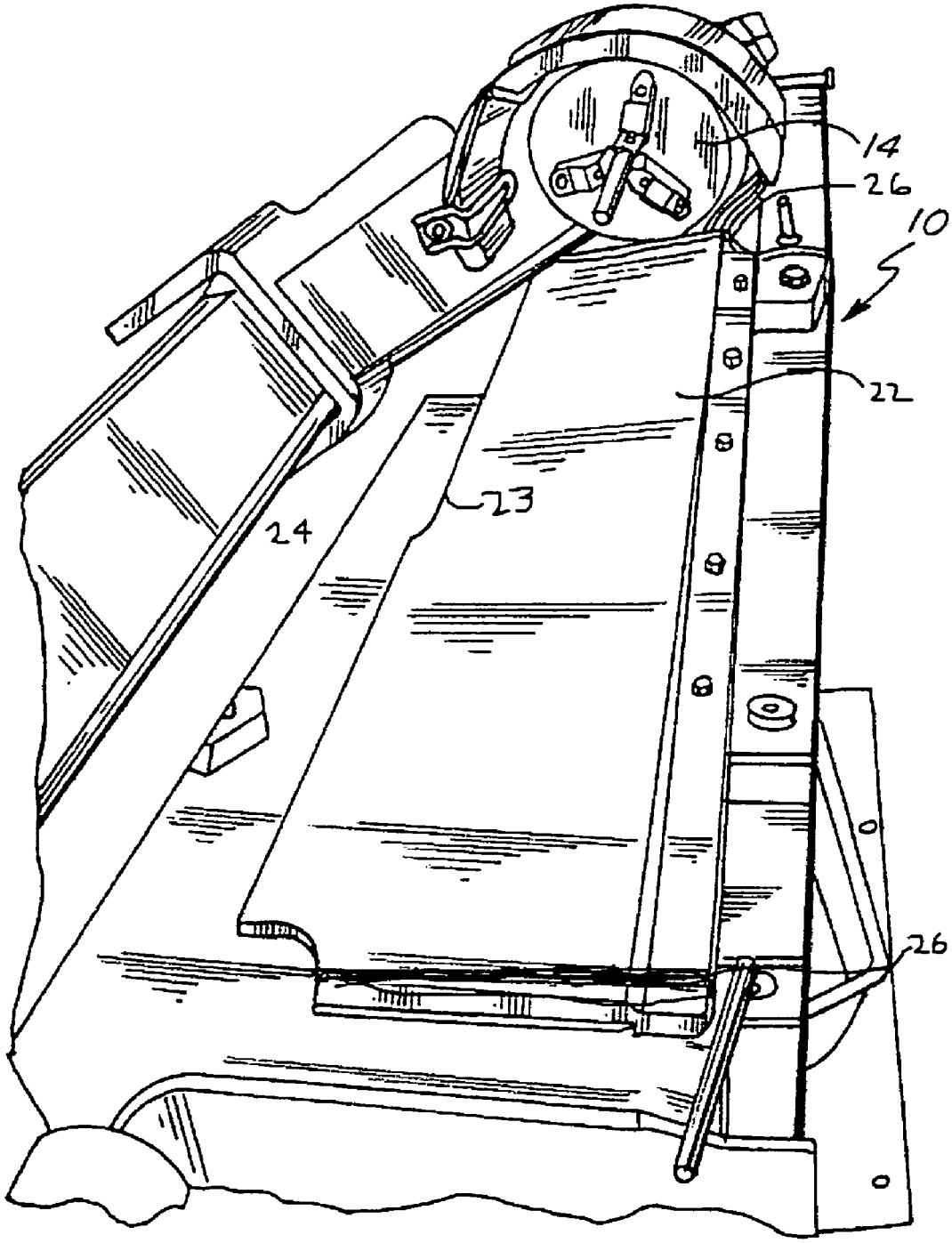
FIG. 1 is a perspective view of the apparatus of the present invention before inserting a mandrel.

FIGS. 1–6 show the apparatus for manufacturing a bat having an exterior and a hollow interior. The single-station apparatus is generally designated in the Figures as reference numeral 10. The apparatus 10 comprises a mandrel 12; a mandrel holder 14 allowing rotation of the mandrel 12; a resin applicator 16 adjacent the mandrel; a resin pad or shelf 22 having substantially the same length as the mandrel 12 to spread resin along the mandrel 12; a filament winder 18 for winding filament onto the mandrel 12, the winding causing the mandrel 12 to rotate in the mandrel holder 14 and causing layers of filament F to be applied to the mandrel as resin R is applied from the resin applicator 16; and a vacuum transfer molding apparatus for applying additional resin (not shown) to the filament-wound mandrel and causing resin to impregnate the filament layers on the mandrel.

Referring now to FIG. 1 there is shown generally at 10 one embodiment of the apparatus of the present invention. Apparatus 10 has a mandrel holder 14 that rotates. Mandrel holder 14 holds a mandrel or other form about which the bat in process is made. A resin pad or shelf 22 is provided to spread resin R from a single stream to a more consistent application covering the entire mandrel (12 in FIGS. 2–3) or portion thereof. The resin pad 22 may also remove excess resin from the mandrel (12 in FIGS. 2–3) and direct the excess resin into a catch basin 24. The resin pad 22 can be raised or lowered to change the distance between the bat in process or mandrel and the resin pad 22. An offset 23 is provided in the resin pad 22 to conform with the shape of the mandrel 12. Knives 26 are provide to shape and/or cut off ends of the bat in process and the fibers that pass beyond the length of the bat.

Figure 2:
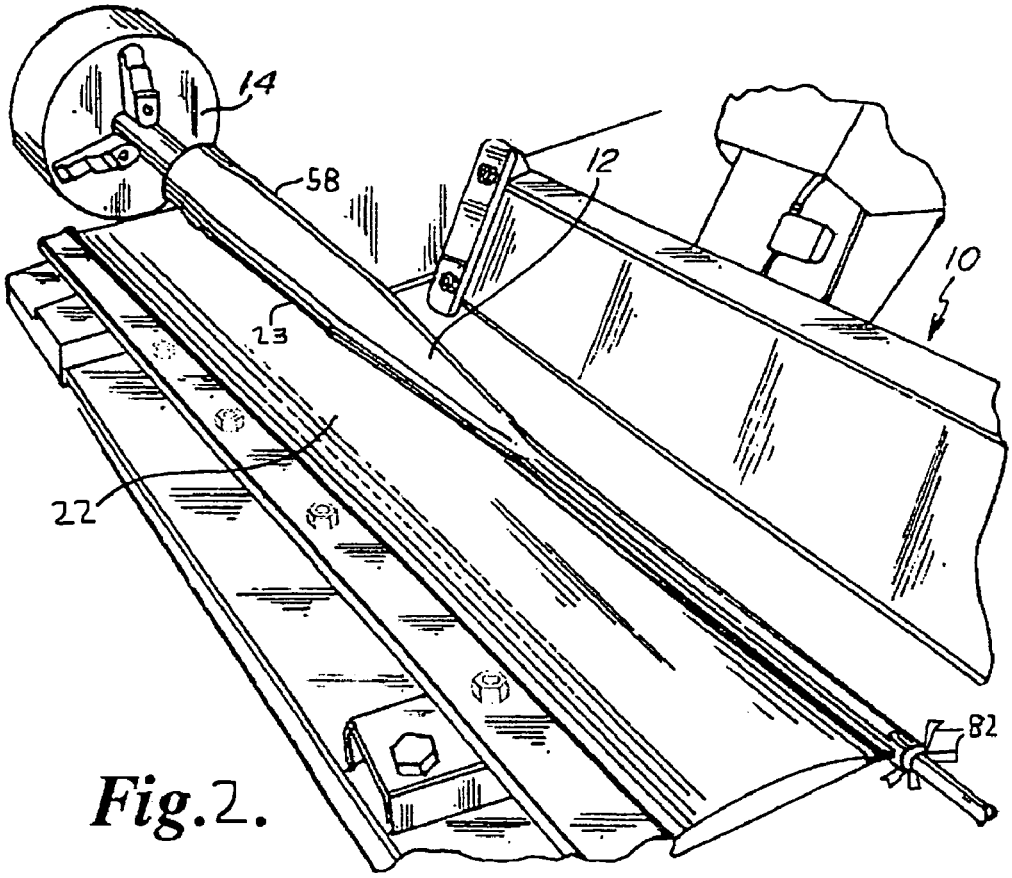
FIG. 2 is a perspective view of the apparatus of the present invention with a mandrel inserted before the first step of filament winding.

FIG. 2 shows the apparatus 10 into which a mandrel 12 is placed. Again, the mandrel 12 is held by mandrel holder 14. Again, in the preferred embodiment, a mandrel 12 is used. However, it should be appreciated that any form may be used. The space between the mandrel 12 and the resin shelf 22 can be adjusted. The offset 23 is provided to conform to the barrel portion 58 of the form or mandrel 12.

Figure 3:
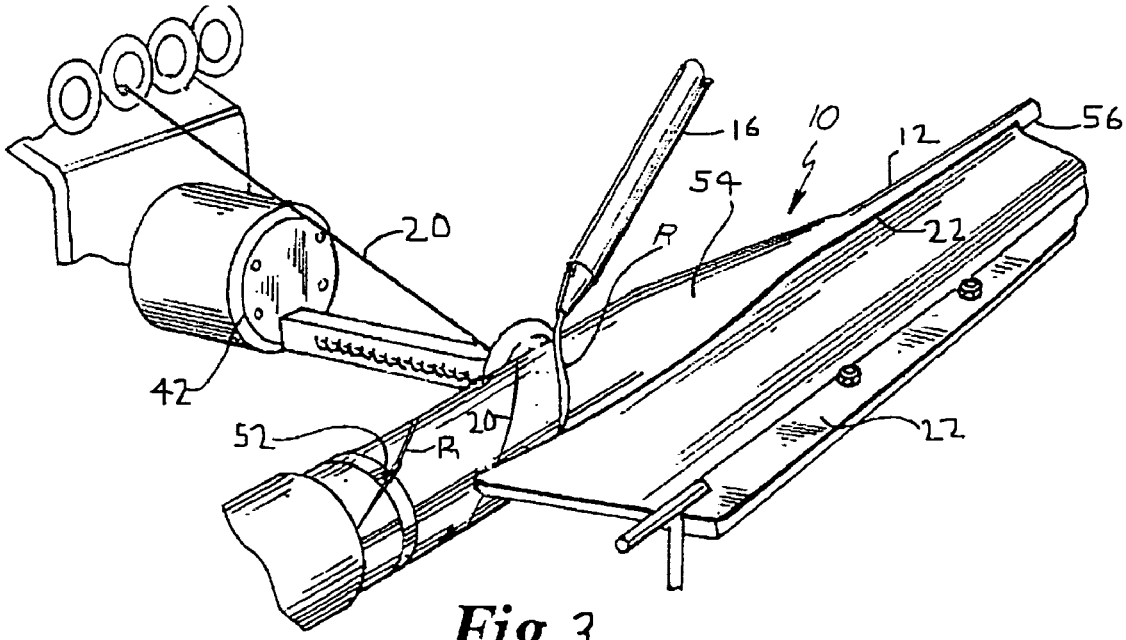
FIG. 3 is a perspective view of the apparatus of the present invention as the first layer of filament is being wound onto the mandrel with simultaneous application of resin.
Figure 5A:
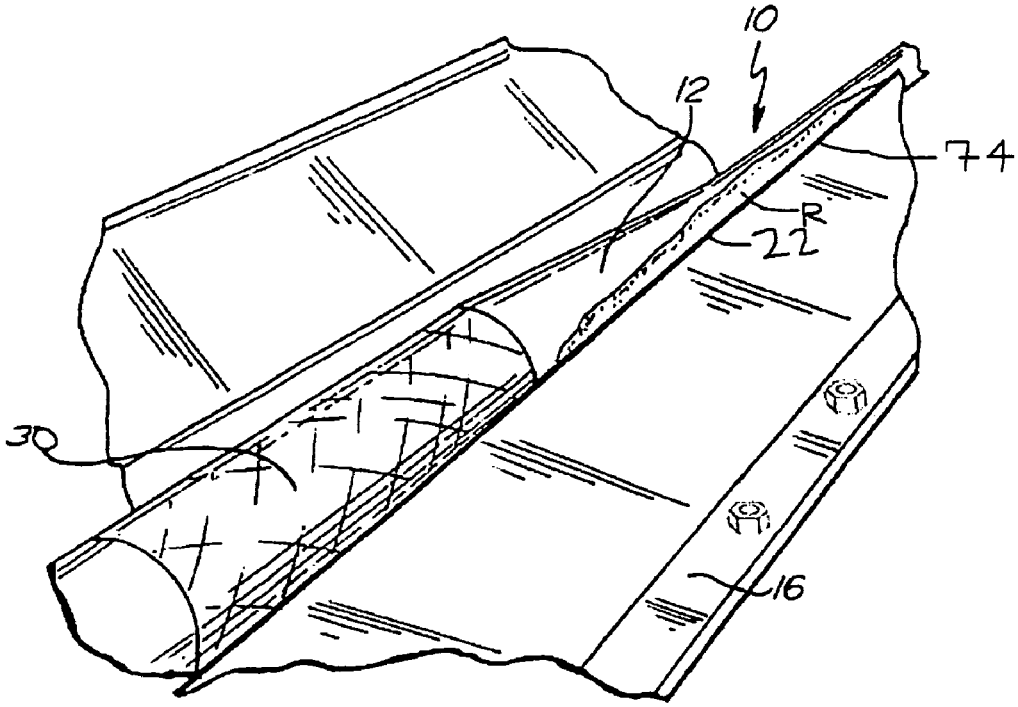
FIGS. 5A and 5B are perspective views of the apparatus of the present invention showing the mandrel with resin added to the first layer of filament and covering the entire length of the mandrel.

FIG. 3 shows one embodiment of how the apparatus 10 places filament and resin over the mandrel. The filament feeder 42 feeds fiber or filament 20 over the mandrel 12. Further, a scraper 28 can be placed on the edge of the resin shelf 22 to clear excess resin off the mandrel 12 and to spread the resin over the mandrel 12 as best seen in FIG. 5A. As the mandrel 12 is rotated, filament feeder 42 is moved back and forth along the entire length of the mandrel 12 or a portion thereof. In the preferred embodiment, filament is first applied proximal cap end 52. Filament feeder 42 is the moved along the mandrel 12 until it reaches a point proximal taper 54 at which point the filament feeder moves back toward cap end 52. However, the filament 20 may be applied back and forth along the entire length of the mandrel 12. This process is repeated several times. At some point in the preferred embodiment, the hitting section of the bat or the section between the cap end 52 and the taper 54 reaches a desired thickness at which point the filament feeder 42 is the moved from cap end 52 to knob end 56 completing the construction of the entire bat. However, the filament feeder 42 can be moved back and forth between any desired points to achieve any desired thickness. In the preferred embodiment, the speed of the rotation of the mandrel holder 14 is controlled by a computer program. In the preferred embodiment, the lateral movement of the filament feeder is controlled by computer program. Pins 82 may be provided at either end of the mandrel 12 to hold the filament 20 in place as the feeder 42 changes directions. Pins 82 are usually beneficial at the handle end of the mandrel whereas the thicker barrel end usually folds the fiber 20 in place when the feeder 42 changes direction at the barrel end.

Figure 4:
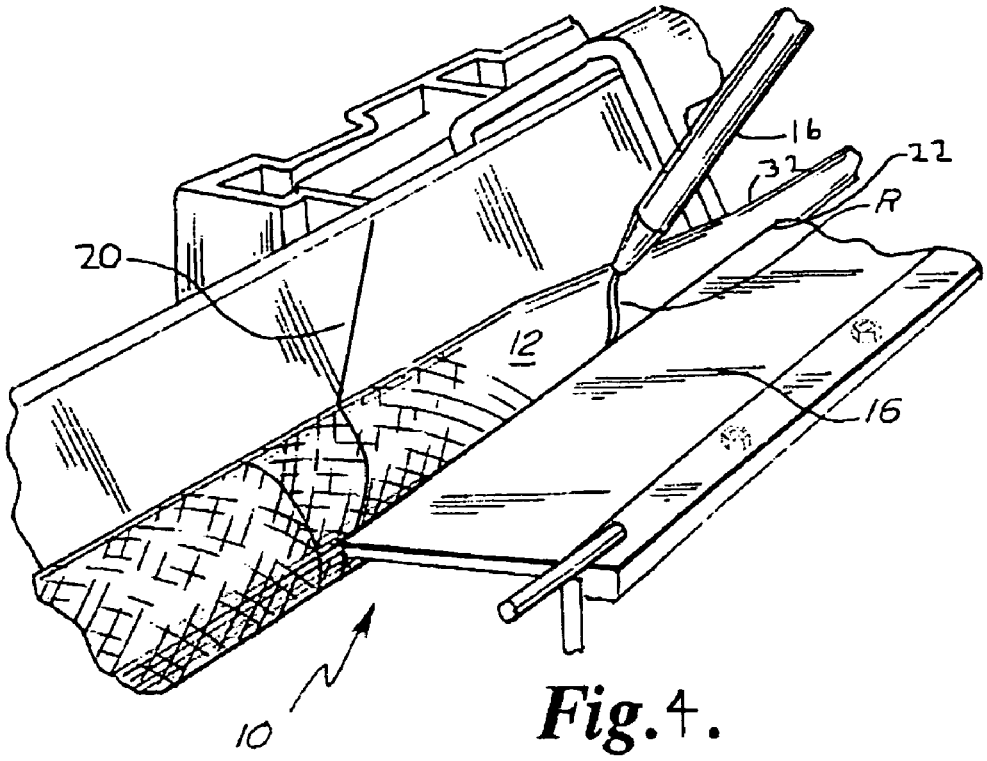
FIG. 4 is similar to FIG. 3 and shows the application of additional resin at an additional point along the mandrel.

FIG. 4 shows how the filament 20 and the resin R can be applied to points between the taper 54 and the knob end 56. After the desired thickness of the hitting area 30 is achieved, filament feeder (42 in FIG. 4) is then moved toward the knob end 56. Likewise, resin applicator 16 is also moved toward knob end 56. Resin and fiber can then be placed between the knob end 56 and the taper 54 (or whatever other point is used to terminate the hitting section) or can be run back and forth between knob end 56 and cap end 52 to form handle area 32.

Comparing FIG. 4 and FIG. 5A, one can see how resin pad 22 can be used to turn the single stream of resin shown in FIG. 4 to an expanded area shown in FIG. 5A. In the preferred embodiment, filament feeder 42 has multiple filament sources thereby allowing different types of filaments to be applied to different sections of the mandrel. Filament feeder can deliver dry (no resin fibers), pre-impregnated fibers, and/or tape (dry or pre-impregnated).

Figure 5B:
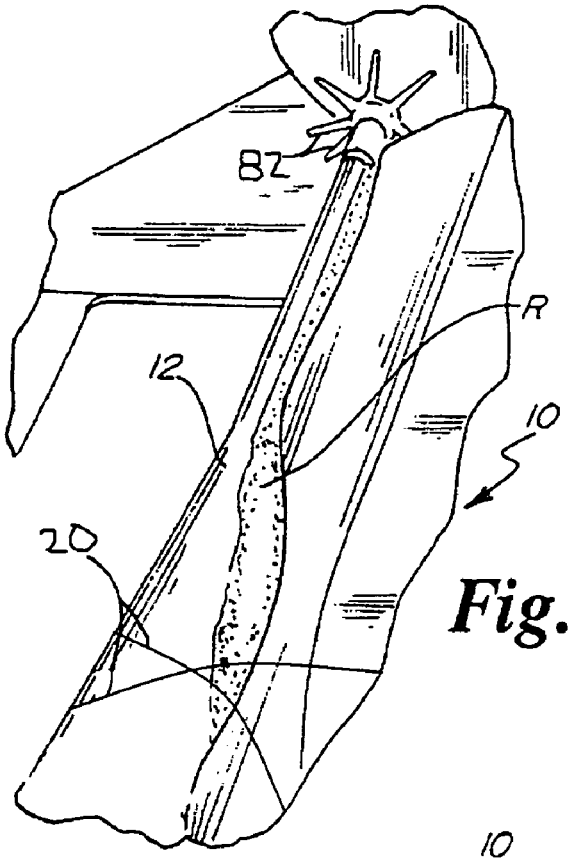

FIG. 5B shows that when the filament feeder moves back and forth, the fibers 20 are placed at angles to one another.

Figure 6:
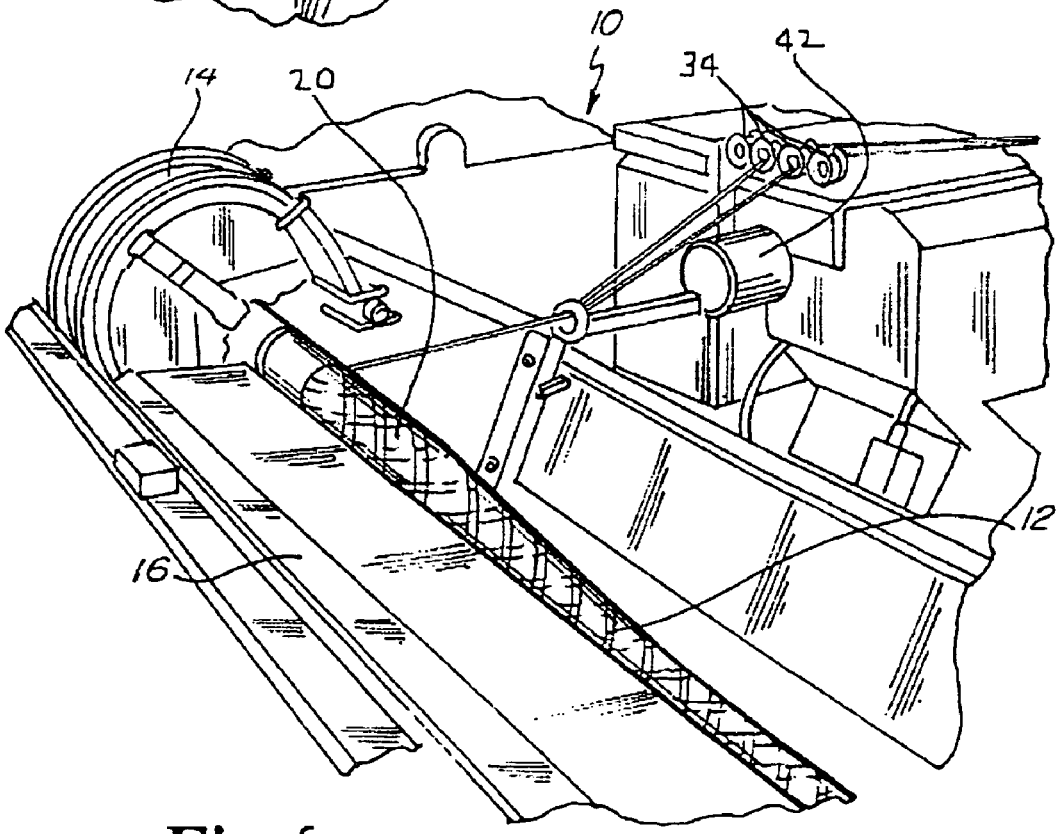
FIG. 6 is a perspective view of the apparatus of the present invention showing the mandrel with all outer filament layers wound onto the mandrel prior to insertion into the vacuum transfer mold.
Figure 7:
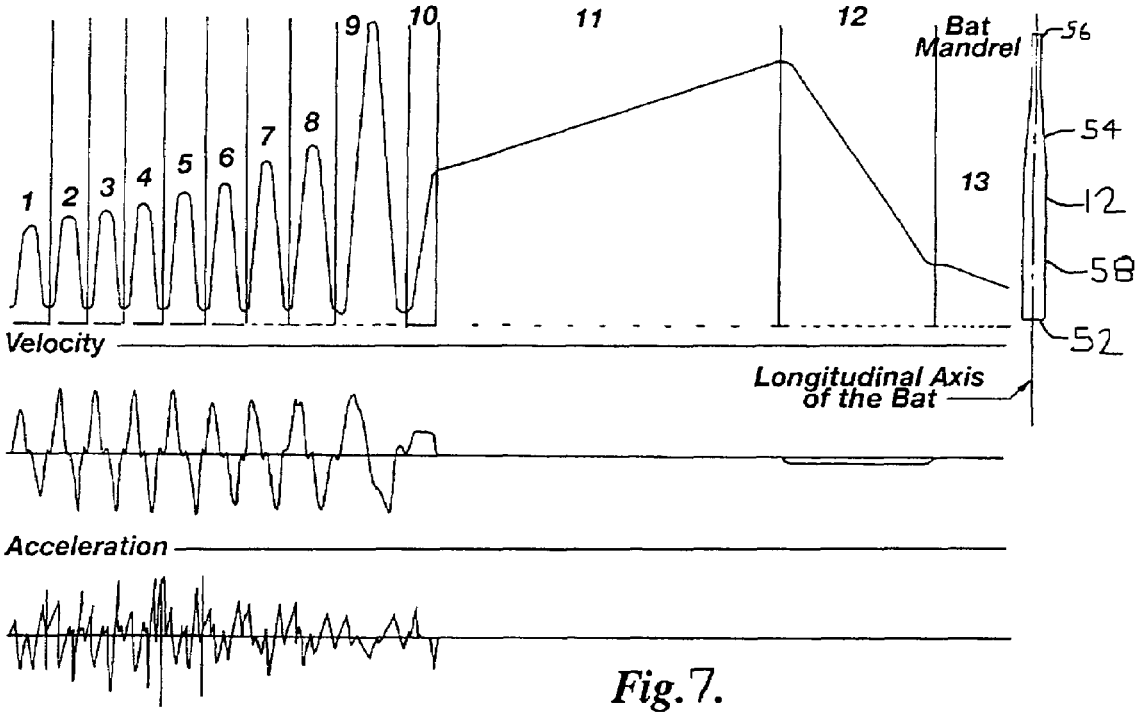
FIG. 7 is a drawing showing a preferred embodiment of a winding pattern.

FIG. 6 shows that more than one filament 20 may be applied at once. Likewise, FIG. 6 also shows multiple filament sources 34 on filament feeder 42. FIG. 7 also shows the position of the feeder 42 at different segments.

It should be recognized that the apparatus disclosed herein can may a variety of different bats with a variety of different wind angles. FIG. 7 shows the winding pattern of a first preferred embodiment. The top grid shows the distance that the winding covers on the mandrel 12. The middle grid shows the velocity of the feeder 42. The lower grid shows the acceleration of the feeder 42. The mandrel 12 is placed in the mandrel holder 14 of the apparatus 10. A predetermined amount of resin is applied at a predetermined amount at three locations along the mandrel 12. Thirteen winding patterns are then applied to the mandrel. The first winding pattern preferably starts at the cap end 52 of the mandrel, applies the fiber at about a 17.45 degree angle with the longitudinal axis of the bat, progresses about half way along the barrel portion 18 and then returns to the cap end 52. The first winding pattern is performed seven times. The second winding pattern preferably starts at the cap end 52 of the mandrel, applies the fiber at about a 17.14 degree angle with the longitudinal axis of the bat, progresses a bit beyond the first winding pattern along the barrel portion 18 and then returns to the cap end 52. The second winding pattern is performed seven times. The third winding pattern preferably starts at the cap end 52 of the mandrel, applies the fiber at about a 17.08 degree angle with the longitudinal axis of the bat, progresses a bit beyond the second winding pattern along the barrel portion 18 and then returns to the cap end 52. The third winding pattern is performed nine times. The fourth winding pattern preferably starts at the cap end 52 of the mandrel, applies the fiber at about a 16.78 degree angle with the longitudinal axis of the bat, progresses a bit beyond the third winding pattern along the barrel portion 18 and then returns to the cap end 52. The fourth winding pattern is performed nine times. The fifth winding pattern preferably starts at the cap end 52 of the mandrel, applies the fiber at about a 16.41 degree angle with the longitudinal axis of the bat, progresses a bit beyond the fourth winding pattern along the barrel portion 18 and then returns to the cap end 52. The fifth winding pattern is performed six times. The sixth winding pattern preferably starts at the cap end 52 of the mandrel, applies the fiber at about a 16.03 degree angle with the longitudinal axis of the bat, progresses a bit beyond the fifth winding pattern along the barrel portion 18 and then returns to the cap end 52. The sixth winding pattern is performed six times. The seventh winding pattern preferably starts at the cap end 52 of the mandrel, applies the fiber at about a 16.56 degree angle with the longitudinal axis of the bat, progresses a bit beyond the sixth winding pattern along the barrel portion 18 and then returns to the cap end 52. The seventh winding pattern is performed ten times. The eighth winding pattern preferably starts at the cap end 52 of the mandrel, applies the fiber at about a 17.47 degree angle with the longitudinal axis of the bat, progresses a bit beyond the seventh winding pattern along the barrel portion 18 and then returns to the cap end 52. The eighth winding pattern is performed six times. The ninth winding pattern preferably starts at the cap end 52 of the mandrel, applies the fiber at about a 15.60 degree angle with the longitudinal axis of the bat, progresses a bit beyond the eighth winding pattern along the barrel portion 18 and then returns to the cap end 52. The ninth winding pattern is performed forty times. The tenth winding pattern preferably starts at the cap end 52 of the mandrel, applies the fiber at about a 90 degree angle with the longitudinal axis of the bat, progresses to about the taper section 54 and is performed once. The eleventh winding pattern preferably begins at the end of the tenth winding pattern, applies fiber at about a 90 degree angle with the longitudinal axis of the bat, progresses to about the knob end 56 and is performed once. The twelfth winding pattern preferably begins at the end of the eleventh winding pattern, applies fiber at about a 90 degree angle with the longitudinal axis of the bat, progresses from about the knob end 56 to a few inches from the cap end 52 and is performed once. The thirteenth winding pattern preferably begins at the end of the eleventh winding pattern, applies fiber at about a 90 degree angle with the longitudinal axis of the bat, progresses from about the a few inches from the cap end 52 to about the cap end 52 and is performed once. Enough resin is provided to impregnate only a few layers of the fiber leaving the exterior fibers dry. Fibers extending beyond either end of the mandrel 12 are cut off or otherwise removed. The mandrel is then transferred to a vacuum transfer molding such as that disclosed in U.S. Pat. No. 5,811,041 owned by Miken Sports, LLC. to infuse resin to wet out all of the layers. Surface finishing such as painting, decaling, and clear coating is performed. An end cap is applied, A weight may be inserted. The bat is ready for shipment.

It should be noted that each of the windings may represent a layer.

FIG. 7 shows the winding pattern of a second preferred embodiment. The top grid shows the distance that the winding covers on the mandrel 12. The middle grid shows the velocity of the feeder 42. The lower grid shows the acceleration of the feeder 42. The mandrel 12 is placed in the mandrel holder 14 of the apparatus 10. A predetermined amount of resin is applied at a predetermined amount at three locations along the mandrel 12. Thirteen winding patterns are then applied to the mandrel. The first winding pattern preferably starts at the cap end 52 of the mandrel, applies the fiber at about a 17.45 degree angle with the longitudinal axis of the bat, progresses about half way along the barrel portion 18 and then returns to the cap end 52. The first winding pattern is performed seven times. The second winding pattern preferably starts at the cap end 52 of the mandrel, applies the fiber at about a 17.14 degree angle with the longitudinal axis of the bat, progresses a bit beyond the first winding pattern along the barrel portion 18 and then returns to the cap end 52. The second winding pattern is performed seven times. The third winding pattern preferably starts at the cap end 52 of the mandrel, applies the fiber at about a 17.08 degree angle with the longitudinal axis of the bat, progresses a bit beyond the second winding pattern along the barrel portion 18 and then returns to the cap end 52. The third winding pattern is performed nine times. The fourth winding pattern preferably starts at the cap end 52 of the mandrel, applies the fiber at about a 16.78 degree angle with the longitudinal axis of the bat, progresses a bit beyond the third winding pattern along the barrel portion 18 and then returns to the cap end 52. The fourth winding pattern is performed nine times. The fifth winding pattern preferably starts at the cap end 52 of the mandrel, applies the fiber at about a 16.41 degree angle with the longitudinal axis of the bat, progresses a bit beyond the fourth winding pattern along the barrel portion 18 and then returns to the cap end 52. The fifth winding pattern is performed six times. The sixth winding pattern preferably starts at the cap end 52 of the mandrel, applies the fiber at about a 16.03 degree angle with the longitudinal axis of the bat, progresses a bit beyond the fifth winding pattern along the barrel portion 18 and then returns to the cap end 52. The sixth winding pattern is performed six times. The seventh winding pattern preferably starts at the cap end 52 of the mandrel, applies the fiber at about a 16.56 degree angle with the longitudinal axis of the bat, progresses a bit beyond the sixth winding pattern along the barrel portion 18 and then returns to the cap end 52. The seventh winding pattern is performed ten times. The eighth winding pattern preferably starts at the cap end 52 of the mandrel, applies the fiber at about a 17.47 degree angle with the longitudinal axis of the bat, progresses a bit beyond the seventh winding pattern along the barrel portion 18 and then returns to the cap end 52. The eighth winding pattern is performed six times. The barrel portion 58 of the mandrel 12 is then wrapped with some releasing layer such as polypropylene. This polypropylene may be tape or sheet, and may be hand-applied or machine-applied. The ninth winding pattern preferably continues from the eight winding and starts at the cap end 52 of the mandrel, applies the fiber at about a 15.60 degree angle with the longitudinal axis of the bat, progresses to the knob end 56 and then returns to the cap end 52. The ninth winding pattern is performed forty times. The tenth winding pattern preferably starts at the cap end 52 of the mandrel, applies the fiber at about a 90 degree angle with the longitudinal axis of the bat, progresses to about the taper section 54 and is performed once. The eleventh winding pattern preferably begins at the end of the tenth winding pattern, applies fiber at about a 90 degree angle with the longitudinal axis of the bat, progresses to just short of the knob end 56 and is performed once. The twelfth winding pattern preferably begins at the end of the eleventh winding pattern, applies fiber at about a 90 degree angle with the longitudinal axis of the bat, progresses from about the knob end 56 to a few inches from the cap end 52 and is performed once. The thirteenth winding pattern preferably begins at the end of the eleventh winding pattern, applies fiber at about a 90 degree angle with the longitudinal axis of the bat, progresses from about the a few inches from the cap end 52 to about the cap end 52 and is performed once. Enough resin is provided to impregnate only a few layers of the fiber leaving the exterior fibers dry. Fibers extending beyond either end of the mandrel 12 are cut off or otherwise removed. The mandrel is then transferred to a vacuum transfer molding such as that disclosed in U.S. Pat. No. 5,811,041 owned by Miken Sports, LLC. to infuse resin to wet out all of the layers. Surface finishing such as painting, decaling, and clear coating is performed. An end cap is applied, A weight may be inserted. The bat is ready for shipment.

FIG. 7 shows the winding pattern of a third preferred embodiment. The top grid shows the distance that the winding covers on the mandrel 12. The middle grid shows the velocity of the feeder 42. The lower grid shows the acceleration of the feeder 42. The mandrel 12 is placed in the mandrel holder 14 of the apparatus 10. A predetermined amount of resin is applied at a predetermined amount at three locations along the mandrel 12. Thirteen winding patterns are then applied to the mandrel. The first winding pattern preferably starts at the cap end 52 of the mandrel, applies the fiber at about a 17.45 degree angle with the longitudinal axis of the bat, progresses about half way along the barrel portion 18 and then returns to the cap end 52. The first winding pattern is performed seven times. The second winding pattern preferably starts at the cap end 52 of the mandrel, applies the fiber at about a 17.14 degree angle with the longitudinal axis of the bat, progresses a bit beyond the first winding pattern along the barrel portion 18 and then returns to the cap end 52. The second winding pattern is performed seven times. The third winding pattern preferably starts at the cap end 52 of the mandrel, applies the fiber at about a 17.08 degree angle with the longitudinal axis of the bat, progresses a bit beyond the second winding pattern along the barrel portion 18 and then returns to the cap end 52. The third winding pattern is performed nine times. The fourth winding pattern preferably starts at the cap end 52 of the mandrel, applies the fiber at about a 16.78 degree angle with the longitudinal axis of the bat, progresses a bit beyond the third winding pattern along the barrel portion 18 and then returns to the cap end 52. The fourth winding pattern is performed nine times. The apparatus is stopper or paused so that a releasing layer such as polypropylene in either tape or sheet form can be applied. Resin is then applied to the releasing layer at three pre-determined points. Preferably continuing from the fourth winding pattern, the fifth winding pattern preferably starts at the cap end 52 of the mandrel, applies the fiber at about a 16.41 degree angle with the longitudinal axis of the bat, progresses a bit beyond the fourth winding pattern along the barrel portion 18 and then returns to the cap end 52. The fifth winding pattern is performed six times. The sixth winding pattern preferably starts at the cap end 52 of the mandrel, applies the fiber at about a 16.03 degree angle with the longitudinal axis of the bat, progresses a bit beyond the fifth winding pattern along the barrel portion 18 and then returns to the cap end 52. The sixth winding pattern is performed six times. The seventh winding pattern preferably starts at the cap end 52 of the mandrel, applies the fiber at about a 16.56 degree angle with the longitudinal axis of the bat, progresses a bit beyond the sixth winding pattern along the barrel portion 18 and then returns to the cap end 52. The seventh winding pattern is performed ten times. The eighth winding pattern preferably starts at the cap end 52 of the mandrel, applies the fiber at about a 17.47 degree angle with the longitudinal axis of the bat, progresses a bit beyond the seventh winding pattern along the barrel portion 18 and then returns to the cap end 52. The eighth winding pattern is performed six times. The barrel portion 58 of the mandrel 12 is then wrapped with some releasing layer such as polypropylene. This polypropylene may be tape or sheet, and may be hand-applied or machine-applied. The ninth winding pattern preferably continues from the eight winding and starts at the cap end 52 of the mandrel, applies the fiber at about a 15.60 degree angle with the longitudinal axis of the bat, progresses to the knob end 56 and then returns to the cap end 52. The ninth winding pattern is performed forty times. The tenth winding pattern preferably starts at the cap end 52 of the mandrel, applies the fiber at about a 90 degree angle with the longitudinal axis of the bat, progresses to about the taper section 54 and is performed once. The eleventh winding pattern preferably begins at the end of the tenth winding pattern, applies fiber at about a 90 degree angle with the longitudinal axis of the bat, progresses to just short of the knob end 56 and is performed once. The twelfth winding pattern preferably begins at the end of the eleventh winding pattern, applies fiber at about a 90 degree angle with the longitudinal axis of the bat, progresses from about the knob end 56 to a few inches from the cap end 52 and is performed once. The thirteenth winding pattern preferably begins at the end of the eleventh winding pattern, applies fiber at about a 90 degree angle with the longitudinal axis of the bat, progresses from about the a few inches from the cap end 52 to about the cap end 52 and is performed once. Enough resin is provided to impregnate only a few layers of the fiber leaving the exterior fibers dry. Fibers extending beyond either end of the mandrel 12 are cut off or otherwise removed. The mandrel is then transferred to a vacuum transfer molding such as that disclosed in U.S. Pat. No. 5,811,041 owned by Miken Sports, LLC. to infuse resin to wet out all of the layers. Surface finishing such as painting, decaling, and clear coating is performed. An end cap is applied, A weight may be inserted. The bat is ready for shipment.

Figure 8:
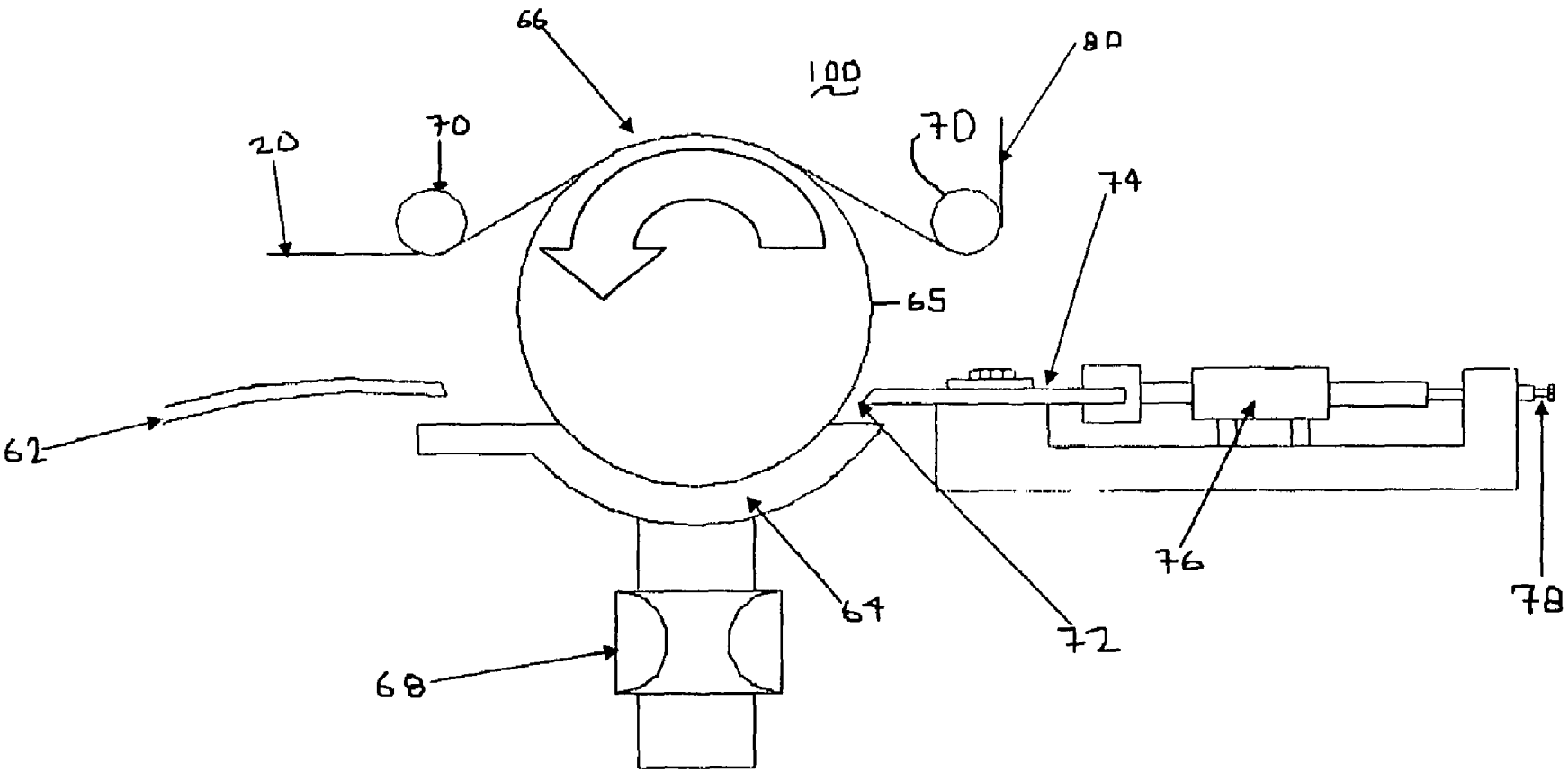
FIG. 8 is an end view of adjustable resin bath that forms one embodiment of the present invention.

FIGS. 7–9 also demonstrates that lateral movement of the filament feeder 42 must be choreographed with the rotation speed of the mandrel 12 in the mandrel holder 14 to make sure that the appropriate number of windings are made at the desired angle.

Referring now to FIG. 8, there is shown generally a resin bath 100 that may be used in addition to or to replace the resin applicator 16 described above. In the preferred embodiment, the resin bath 100 is placed along the fiber or filament stream prior to filament feeder 42. Filament 20 is fed from a dry fiber tow 80 over a roller 70 prior to contacting the resin drum 66. The resin drum 66 rotates in the same direction as the fiber feed that is in the perspective of FIG. 8 counterclockwise. The resin drum 66 lies immediately above resin reservoir 64 so that rotation of the resin drum 66 allows its surface 65 to receive a controlled amount of resin from the reservoir 64. The amount of resin placed on the drum surface 65 is controlled by the depth of the resin in the reservoir and the distance between the drum 66 and the reservoir 64. Additionally, a squeegee 74 can be provided to additionally control the amount of resin on the surface 65. The size of a gap 72 provided between the squeegee 74 and the surface 65 can be changed by a cylinder 76 have a squeegee adjust control knob 78. Additionally, the cylinder 76 may be computer controlled. Resin may be delivered to the reservoir 64 through any source including resin inlet 62 with is merely a hose or pipe from a source. Resin depth in reservoir 64 may be controlled by how much is added from the inlet 62 or how much is removed through a valve 68 such as a pinch valve. By applying the resin to the filament 20 in the manner shown in FIG. 9, less excess resin is placed on the mandrel described above. It should also be understood that an idler and splicer may be placed proximal the dry fiber tow 80 so that a continuous feed of fiber and/or tape of differing materials can be applied.

In the preferred embodiment, the filament 20 is placed on a mandrel 12. However, it should be recognized that the mandrel 12 can be replaced with any form. In fact, if the process is used to create one or more composite layers over an existing bat frame such as a wooden or metal bat, the wooden or metal bat frame may be used as the form.

It should also be understood that between any one or more layers of filament, a releasing layer of a material such as polypropylene or other suitable material that keeps the adjacent layers of materials from being adhered together by the resin can also be used. It should also be noted that either a single strand of fiber or a fiber twine may be used.

It should also be noted that multiple filament feeders 42 and multiple mandrel holders 14 may be used. In the preferred arrangement, the feeders 42 and holders 14 would be vertically stacked. In one aspect, the present invention comprises an apparatus for manufacturing a bat having an exterior and a hollow interior.

The resin may be any resin suitable for use in vacuum transfer molding. For example and without exclusion, the resin may be a low viscosity epoxy casting resin manufactured by Epic Resins, 600 Industrial Blvd., Palmyra, Wis. 53156. Additional resins are disclosed in U.S. Pat. No. 5,811,041, herein incorporated by reference. The filament may be any suitable fiber. For example and without exclusion, the filament may be a fiber manufactured by Toray Carbon Fibers America, Inc., 6 Hutton Centre Drive, Suite 1270, Santa Ana, Calif. 92707. The filament winder 18 may be as previously disclosed in U.S. Pat. No. 6,776,735, herein incorporated by reference. In particular, the filament winder may be the Super Hornet Winder WSH-1-4-2M-OMNIPC manufactured by McClean Anderson Corp., P.O. Box 20, 300 Ross Ave., Schofield, Wis. 54476-0200. The molding apparatus may be as previously disclosed in U.S. Pat. No. 5,811,041, herein incorporated by reference. The preferred pre-impregnated tape is under the Aldila brand.

In one aspect, the present invention comprises a bat having an exterior and a hollow interior, manufactured by the above-described process.

Yet another preferred embodiment is created by applying enough resin so that the first thickness of the bat is wet wound while the second thickness is dry wound. This first thickness and second thickness are then placed in a resin transfer matrix (RTM). A releasing layer preferably of polypropylene is then placed over the first and second thickness after RTM. Enough resin is then applied to the releasing layer so that the third thickness can be wet wound and the fourth thickness can be dry wound. The mandrel having the fourth thickness is then placed in RTM. An additional releasing layer is placed over the fourth thickness. This is repeated until the desired bat thickness is achieved. In the preferred embodiment, this is performed four times so that each thickness is about an eighth and there are four wet wound, dry wound, and releasing layer layers.

Yet another preferred embodiment uses one or two pre-impregnated sheets placed over the form. If two pre-impregnated sheets are used, a releasing layer is placed in between. Fiber is then dry wound over the outer pre-impregnated sheet. The resulted combination of pre-impregnated sheets and filament is then placed in RTM.

Unless otherwise defined, all technical and scientific terms used herein have the same meaning as commonly understood by one of ordinary skill in the art to which this invention belongs. Although methods and materials similar to or equivalent to those described herein can be used in the practice or testing of the present invention, suitable methods and materials are described below. All publications, patent applications, patents, and other references mentioned herein are incorporated by reference in their entirety to the extent allowed by applicable law and regulations. In case of conflict, the present specification, including definitions, will control.

The present invention may be embodied in other specific forms without departing from the spirit or essential attributes thereof, and it is therefore desired that the present embodiment be considered in all respects as illustrative and not restrictive, reference being made to the appended claims rather than to the foregoing description to indicate the scope of the invention.

What is claimed is:

1. A bat having a cap end, a knob end, a barrel, and a taper, the bat comprising:

a first layer of filament from proximal the cap end having a fiber angle of less than 20 degrees with respect to the longitudinal axis of the bat;

a second layer of filament from proximal the cap end having a fiber angle of less than 20 degrees with respect to the longitudinal axis of the bat around the first layer;

a third layer of filament from proximal the cap end having a fiber angle of less than 20 degrees with respect to the longitudinal axis of the bat around the second layer;

a fourth layer of filament from proximal the cap end having a fiber angle of less than 20 degrees with respect to the longitudinal axis of the bat around the third layer;

a fifth layer of filament from proximal the cap end having a fiber angle of less than 20 degrees with respect to the longitudinal axis of the bat around the fourth layer;

a sixth layer of filament from proximal the cap end having a fiber angle of less than 20 degrees with respect to the longitudinal axis of the bat around the fifth layer;

a seventh layer of filament from proximal the cap end having a fiber angle of less than 20 degrees with respect to the longitudinal axis of the bat around the sixth layer;

an eight layer of filament from proximal the cap end having a fiber angle of less than 20 degrees with respect to the longitudinal axis of the bat around the seventh layer;

a ninth layer of filament from proximal the cap end having a fiber angle of less than 20 degrees with respect to the longitudinal axis of the bat around the eighth layer;

at least one outer layer of filament from proximal the cap end having a fiber angle of about 90 degrees with respect to the longitudinal axis of the bat around the ninth layer; and a release layer between the ninth layer and the at least one outer layer.

2. The bat of claim 1 further comprising a release layer between any two of the layers.

3. The bat of claim 1 further comprising a second resin applied to the at least one outer layer.

4. The bat of claim 1 further comprising a surface finish around the at least one outer layer.

5. The bat of claim 1 further comprising a first resin applied to the first layer that leaves the eighth layer dry.

6. A bat having a cap end, a knob end, a barrel, and a taper, the bat comprising:

a first layer of filament from proximal the cap end having a fiber angle of less than 20 degrees with respect to the longitudinal axis of the bat;

a second layer of filament from proximal the cap end having a fiber angle of less than 20 degrees with respect to the longitudinal axis of the bat around the first layer;

a third layer of filament from proximal the cap end having a fiber angle of less than 20 degrees with respect to the longitudinal axis of the bat around the second layer;

a fourth layer of filament from proximal the cap end having a fiber angle of less than 20 degrees with respect to the longitudinal axis of the bat around the third layer;

a fifth layer of filament from proximal the cap end having a fiber angle of less than 20 degrees with respect to the longitudinal axis of the bat around the fourth layer;

a sixth layer of filament from proximal the cap end having a fiber angle of less than 20 degrees with respect to the longitudinal axis of the bat around the fifth layer;

a seventh layer of filament from proximal the cap end having a fiber angle of less than 20 degrees with respect to the longitudinal axis of the bat around the sixth layer;

an eight layer of filament from proximal the cap end having a fiber angle of less than 20 degrees with respect to the longitudinal axis of the bat around the seventh layer;

a ninth layer of filament from proximal the cap end having a fiber angle of less than 20 degrees with respect to the longitudinal axis of the bat around the eighth layer;

at least one outer layer of filament from proximal the cap end having a fiber angle of about 90 degrees with respect to the longitudinal axis of the bat around the ninth layer; and a first resin applied to the first layer that leaves the eighth layer dry.

* * * * *